US007599254B2

(12) United States Patent
Oliver

(10) Patent No.: US 7,599,254 B2
(45) Date of Patent: Oct. 6, 2009

(54) TRANSDUCER STATIC DISCHARGE METHODS AND APPARATUS

(75) Inventor: Nelson H. Oliver, Sunnyvale, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 741 days.

(21) Appl. No.: 11/313,973

(22) Filed: Dec. 20, 2005

(65) Prior Publication Data

US 2007/0140515 A1 Jun. 21, 2007

(51) Int. Cl.
*B06B 1/00* (2006.01)

(52) U.S. Cl. ..... 367/140; 367/901

(58) Field of Classification Search ..... 367/140, 367/181, 901
See application file for complete search history.

(56) References Cited

U.S. PATENT DOCUMENTS 7,274,623 B2 * 9/2007 Bayram et al. ..... 367/140
7,303,530 B2 * 12/2007 Barnes et al. ..... 600/459
2004/0236223 A1 * 11/2004 Barnes et al. ..... 600/459
2005/0219953 A1 * 10/2005 Bayram et al. ..... 367/178
2006/0279174 A1 * 12/2006 Oliver et al. ..... 310/338
2007/0140515 A1 * 6/2007 Oliver ..... 381/174

OTHER PUBLICATIONS

U.S. Appl. No. 11/152,632, filed Jun. 14, 2005.

High-Frequency CMUT Arrays for High-Resolution Medical Imaging Abstract; located at http://spiedl.aip.org/getabs/servlet/GetablsServlet?prog_normal&id_PSISDG005750000 . . . ; printed on Oct. 20, 2005; 2 pages.

* cited by examiner

*Primary Examiner*—Dan Pihulic

(57) ABSTRACT

Light exposure may reduce the static charge inside a capacitive membrane transducer. For example, ultraviolet light shines on or in a cell. The light increases the energy of the charge carrier and/or ionizes gas in the cavity, allowing reverse migration or dissipation of the static charge.

20 Claims, 1 Drawing Sheet

TRANSDUCER STATIC DISCHARGE METHODS AND APPARATUS

BACKGROUND

The present embodiments relate to ultrasound transducers, such as capacitive membrane ultrasound transducers (CMUTs) for medical diagnostic imaging. For a CMUT, microelectromechanical processes form an array of elements, such as a one or two-dimensional array of elements. Each element a plurality of cells or membranes with associated electrodes separated by includes a gap or void. Flexing of the membranes in response to acoustic energy generates an electrical signal. Applying an electrical signal across the electrodes similarly causes the membrane to flex, producing acoustic energy. To provide desired response, a bias voltage is also applied across the electrodes.

An insulating layer, such as silicon dioxide, covers or is adjacent one or each of the electrodes. As the CMUT is used, electrical charge may migrate across the insulating layer. The charge is maintained as static or surface charge. Accumulation of the surface charge may deteriorate the CMUT response.

BRIEF SUMMARY

By way of introduction, the preferred embodiments described below include methods, transducers and systems for reducing static charge. Light exposure may reduce the static charge. For example, ultraviolet light shines on or in a cell. The light increases the energy of the charge carriers or ionizes gas in the cavity, allowing reverse migration or dissipation of the static charge.

In a first aspect, a capacitive membrane ultrasound transducer is provided for reducing static charge. At least one cell is operable to transduce between ultrasound and electrical energies. An ultraviolet light source is directed at the at least one cell.

In a second aspect, a capacitive membrane transducer is provided for reducing static charge. At least one cell is a membrane, cavity and a first electrode. A light source is directed at the at least one cell.

In a third aspect, a method is provided for discharging static charge in a capacitive membrane transducer. The capacitive membrane transducer transduces between acoustic and electrical energy. Radiant electromagnetic energy is applied within a cell of the capacitive membrane transducer.

The present invention is defined by the following claims, and nothing in this section should be taken as a limitation on those claims. Further aspects and advantages of the invention are discussed below in conjunction with the preferred embodiments and may be later claimed independently or in combination.

BRIEF DESCRIPTION OF THE DRAWINGS

The components and the figures are not necessarily to scale, emphasis instead being placed upon illustrating the principles of the invention. Moreover, in the figures, like reference numerals designate corresponding parts throughout the different views.

DETAILED DESCRIPTION OF THE DRAWINGS AND PRESENTLY PREFERRED EMBODIMENTS

Pulses of radiant electromagnetic energy, such as ultraviolet light, dissipate static charge within the CMUT cells. The radiant energy is routed in a waveguide or other channel structure to each of the cells. The channel structure is formed in the silicon substrate. Alternatively, the light is generated within each cell. For pulsed ionizing radiation, the transient electrical conductivity induced in the gas in the CMUT cavities permits the dissipation of static electrical charge. For non-ionizing radiation, the increase in energy may allow for reverse migration of the charge through the insulating layer, such as silicon dioxide. Periodic pulsing of radiant energy allows continued use of the CMUT for acoustic transduction with less surface charge effects.

Figure 1:
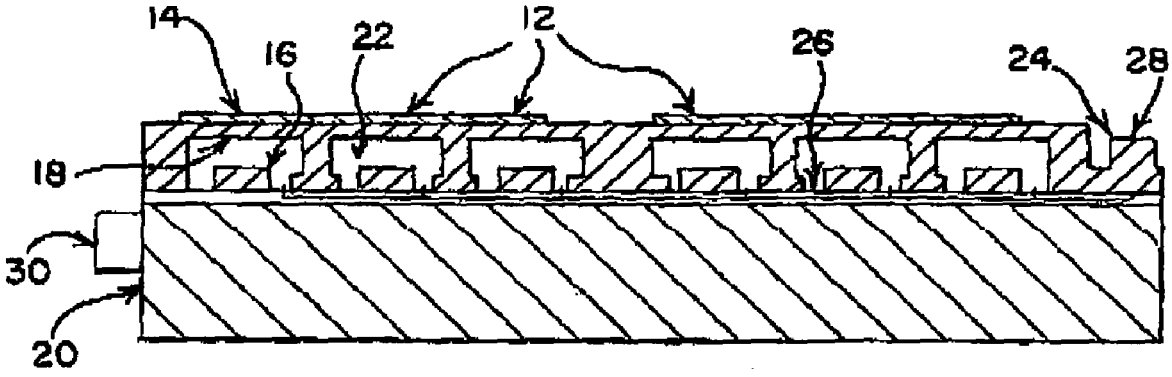
FIG. 1 is a cross-section view of one embodiment of a capacitive membrane transducer.

FIG. 1 shows a capacitive membrane transducer for reducing static charge. The capacitive membrane transducer is a CMUT, but transducers for other acoustic frequencies may be used. The transducer includes at least one cell 12, a light source 24 connected with one of the cells 12, a switch 28, and a bias source 30. Additional, different or fewer components may be provided. For example, the switch 28 and/or bias source 30 are not provided.

Each cell 12 includes a membrane 18 over a cavity 22 with an electrode 14 on the membrane 18 and another electrode 16 within the cavity 22 away from the membrane 18. The cell 12 is formed on a semiconductor substrate 20, such as silicon, using CMOS, VLSI or other semiconductor processes. Each cell 12 has a same or different size than other cells 12. The membrane 18 has a thickness and area based on the desired response, such as a size and thickness for ultrasound transduction. The electrodes 14, 16 are deposited, doped or otherwise formed as part of the cell 12. Other cell structures, such as a beam type membrane, may be used.

Figure 2:
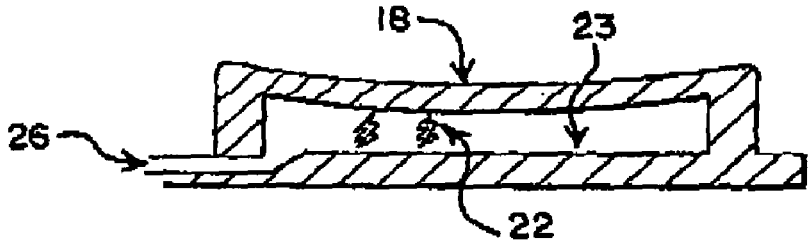
FIG. 2 is a cross-section view of one embodiment of a cell of a capacitive membrane transducer.

The electrodes 14 and 16 are electrically isolated from each other. The electrodes 14, 16 are on different sides of the cavity 22. The membrane 18 may also separate the electrodes 14, 16. As shown in FIG. 2, an insulating layer 23 may also separate the electrodes 14, 16. The insulating layer 23 is silicon dioxide or nitride, but other insulating materials may be used. An insulating layer 23 is provided for each electrode 14, 16, but may be used on only one or none of the electrodes 14, 16.

FIG. 2 shows a single cell 12. FIG. 1 shows six cells 12 in a partial view. Any number of cells 12 may be provided, such as tens or hundreds of cells 12 for each element of a transducer. The cells 12 of a same element may share the same electrodes 14, 16. The cells 12 of different elements may share a same grounding electrode 14. For example, a common ground electrode 14 is deposited over an entire emitting face of a transducer. The signal electrodes 16 for each element may be electrically connected together, such as with a common interconnected network of deposited traces or doping of the substrate 20. Alternatively, separate electrical connections are provided.

Each cell 12 transduces between electrical and acoustic energies. In one embodiment, each cell 12 operates as an analog sensor. An amount of flexing at a given bias voltage determines an amplitude of the energy. In an alternative embodiment, the state of the membrane 18 as collapsed or not collapsed acts as a digital sensor. For example, the structures or methods described in (Publication No. 2006-0279174 (application Ser. No. 11/152,632)), the disclosure of which is incorporated herein by reference, are used. In yet another embodiment, the membrane 18 is collapsed by application of the bias voltage. The membrane 18 contacts an opposite side of the cavity 22. In this collapsed mode, variation in the amount of collapsed membrane area is sensed for transduction.

The light source 24 is an ultraviolet light emitting diode. Other light sources may be used, such as a visible or infrared light source. The light source 24 is bonded to, optically connected to, or formed on the substrate 20. For example, the light source 24 is formed with CMOS or VLSI processes on the substrate 20 at a same or different time as forming the cells 12.

The light source 24 is directed at the cells 12. For example, the light source 24 is within each of the cells 12. One light source 24 is provided for each single cell 12 or adjacent group of cells 12. As another example, a channel 26 routes light from the light source 24 to direct the light at the cells 12. A single or plurality of light sources 24 direct light to a greater number of cells 12 through the channels 26.

The channels 26 are hollow channels in the substrate 20. The channels 26 are etched, deposited, sputtered or otherwise formed. The channels 26 are bare or are coated, such as being silicon dioxide or oxide channels with or without a gold or other coating. Alternatively, the channels 26 are filled, such as being formed as or made from an optical fiber.

The channels 26 are shaped and sized as a waveguide. As an alternative, the channels 26 provide a route for the light without acting as a waveguide.

The channels 26 connect the light source 24 to one or more cells 12. Branches with or without reflective surfaces allow the light to radiate from the light source 24 to the cells 12. The channels 26 open to the cells 12. In one embodiment, the channel openings are positioned to provide more intense light at an insulating layer 23 within the cavity 22. Alternatively, the channel openings generally illuminate the cavity 22. One or more channel openings are provided for each cell 12. FIG. 1 shows two openings in cross-section. FIG. 2 shows a single opening. The openings are holes, slits, rings or other areas. Lens or window structures may be provided at the openings. In alternative embodiments, the light is directed outside the cavity 22. For example, the light is directed at an emitting face of the transducer, at an outer sidewall or at a bottom of the electrode 16 within the cavity 22.

The switch 28 is a transistor. Other switches may be used. The switch 28 is formed with the light source 24, such as on a same substrate, or is remote from the light source 24. The switch 28 controls the light source 24. The switch 28 turns the light source 24 on or off, but may control an output amplitude of the light source 24. In other embodiments, the switch 28 is a microelectromechanical structure within the channels 26 for allowing or not allowing light to pass to selected cells 12.

The bias source 30 is a voltage source. The bias source 30 is part of or separate from any waveform generator used to transmit acoustic energy. The bias source 30 connects with the electrodes 14, 16. The bias source 30 is spaced from or provided, in part, (e.g., amplifier) on the substrate 20. The bias source 30 is programmable or adjustable to apply a different bias when the switch 28 is on than when the switch 28 is off. The different bias may be no voltage or a voltage of an opposite polarity. For example, a positive constant or varying bias voltage is applied while transducing between electrical and acoustic energies. A negative bias voltage is applied while removing static charge. The negative bias has a greater or lesser amplitude than the positive bias. The negative and positive biases may be used for transduction and static dissipation, respectively, in other embodiments.

Figure 3:
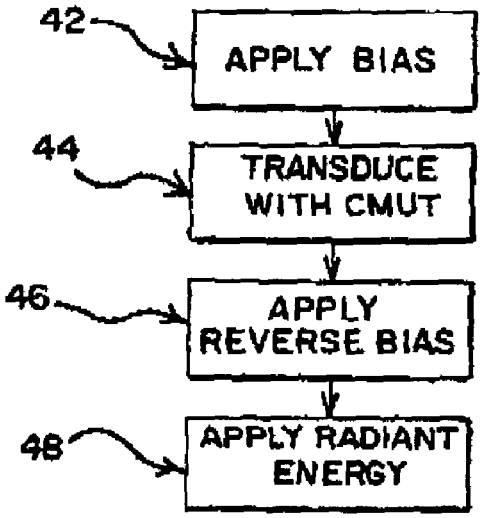
FIG. 3 is a flow chart diagram of one embodiment of a method for reducing static charge.

FIG. 3 shows a method for discharging static charge in a capacitive membrane transducer. One of the transducers shown in FIG. 1 or 2 or a different transducer implements the method. The method is performed in the order shown. Other orders may be used, such as performing acts 46 and 48 prior to performing acts 42 and 44. Additional, different or fewer acts may be provided, such as performing separate processes for adjacent cells.

In act 42, a bias is applied. The bias is a constant voltage or current. The bias may vary, such as different levels of bias for receive and transmit operations or bias varying as a function of depth (delay) during receive operation. The bias collapses or does not collapse the membrane. The bias has a positive or a negative polarity.

In act 44, the capacitive membrane transducer transduces between acoustic and electrical energy. The transducer operates as a digital or analog sensor. The transducer membrane may operate in a collapsed or non-collapsed mode. During operation, a surface or other static charge may result.

In act 46, a different bias is applied. The different bias has a different amplitude, polarity or amplitude and polarity than the bias of act 42. By applying a different polarity, electrical energy may force dissipation of some charge by reverse migration across the insulating layer or may make dissipation more likely. Alternatively, a zero bias is applied in act 46.

In act 48, radiant energy is applied within or to a cell of the capacitive membrane transducer. Any wavelength radiant energy may be used, such as light or ultraviolet light. The radiant energy may extend over a range of frequencies. The light ionizes any gas in the cavity of the cell. The ionized gas dissipates the static charge by a short circuit. Alternatively, the light does not ionize the gas, but does provide energy to the charge carriers. The energy allows or more likely causes dissipation of the static charge. By applying the energy to the insulating layer, the static charge may more readily migrate back to the electrode.

The radiant energy is applied while the transducer is not used for transducing. For example, acts 46 and 48 are performed periodically, such as every 30, 60 or other number of seconds, in interleaved with performing acts 42 and 44. As other examples, a number of uses, a measured charge or other event triggers acts 46 and 48. Alternatively, the radiant energy is applied during transduction, such as during a negative or positive going peak in a transmit waveform.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

I claim:

1. A capacitive membrane ultrasound transducer for reducing static charge, the capacitive membrane ultrasound transducer comprising:

at least one cell operable to transduce between ultrasound and electrical energies; and an ultraviolet light source directed at the at least one cell.

2. The capacitive membrane ultrasound transducer of claim 1 wherein the at least one cell comprises an insulating layer adjacent an electrode, the ultraviolet light source being directed at the insulating layer within a cavity.

3. The capacitive membrane ultrasound transducer of claim 1 wherein the light source is an ultraviolet light emitting diode within the cell or connected with the cell by a channel.

4. The capacitive membrane ultrasound transducer of claim 3 wherein the cell is formed, at least in part, in a semiconductor substrate, and wherein the channel is in the semiconductor substrate.

5. The capacitive membrane ultrasound transducer of claim 3 wherein the channel is a waveguide.

6. A capacitive membrane transducer for reducing static charge, the capacitive membrane transducer comprising:

at least one cell comprising a membrane, cavity and a first electrode; and a light source directed at the at least one cell.

7. The capacitive membrane transducer of claim 6 wherein the at least one cell comprises a plurality of cells sharing the first electrode, the first electrode being a ground electrode, and wherein the light source is directed at each of the plurality of cells.

8. The capacitive membrane transducer of claim 6 wherein the at least one cell further comprises an insulating layer adjacent the first electrode, the light source being directed at the insulating layer.

9. The capacitive membrane transducer of claim 6 wherein the light source is directed within the cavity.

10. The capacitive membrane transducer of claim 6 wherein the light source is an ultraviolet light emitting diode.

11. The capacitive membrane transducer of claim 6 wherein the cell is formed, at least in part, in a semiconductor substrate, and wherein the light source is a channel in the semiconductor substrate, the channel connecting with the cell.

12. The capacitive membrane transducer of claim 6 wherein the light source is a waveguide.

13. The capacitive membrane transducer of claim 6 wherein the cell is operable in a collapse mode with the membrane operable to contact an opposite side of the cavity.

14. The capacitive membrane transducer of claim 6 wherein the cell further comprises a second electrode separate from the first electrode;

further comprising:

a switch connected with the light source; and a bias source connected with the first electrode, the bias source operable to apply a different bias when the switch is on than when the switch is off.

15. A method for discharging static charge in a capacitive membrane transducer, the method comprising:

transducing between acoustic and electrical energy with the capacitive membrane transducer; and applying radiant energy within a cell of the capacitive membrane transducer.

16. The method of claim 15 wherein transducing comprises operating the capacitive membrane transducer in a collapsed mode.

17. The method of claim 15 wherein applying the radiant energy comprises applying ultraviolet light within a cavity of the cell.

18. The method of claim 15 wherein applying the radiant energy comprises applying ultraviolet light to an insulating layer of the cell.

19. The method of claim 15 wherein applying the radiant energy comprises applying the radiant energy while not transducing.

20. The method of claim 15 further comprising:

applying a first bias of a first polarity during transduction; and applying a second bias of a second polarity during the application of the radiant energy, the second polarity different from the first polarity.

* * * * *